US010549451B2

(12) United States Patent
Wagner

(10) Patent No.: US 10,549,451 B2
(45) Date of Patent: Feb. 4, 2020

(54) METHODS AND MACHINES FOR CONSTRUCTING PALLETS

(71) Applicant: Palletec, LLC, Fridley, MN (US)

(72) Inventor: Paul Howard Wagner, Columbia Heights, MN (US)

(73) Assignee: Palletec, LLC, Fridley, MN (US)

( * ) Notice: Subject to any disclaimer, the term of this patent is extended or adjusted under 35 U.S.C. 154(b) by 224 days.

(21) Appl. No.: 15/581,897

(22) Filed: Apr. 28, 2017

(65) Prior Publication Data

US 2017/0312934 A1 Nov. 2, 2017

Related U.S. Application Data

(60) Provisional application No. 62/391,429, filed on Apr. 29, 2016.

(51) Int. Cl.
*B27F 7/00* (2006.01)
*B27M 3/00* (2006.01)

(52) U.S. Cl.
CPC ..... *B27F 7/003* (2013.01); *B27M 3/0073* (2013.01)

(58) Field of Classification Search
CPC ..... F16D 65/0075; F16D 55/228; F16D 2055/0033; F16D 2250/0015; F16D 55/22; F16D 2055/002; B22D 25/02; B22D 19/0072; B60T 17/04; B22C 9/10
See application file for complete search history.

(56) References Cited

U.S. PATENT DOCUMENTS

| | | | | |
|---|---|---|---|---|
| 3,945,549 | A | 3/1976 | Colson | |
| 4,054,236 | A * | 10/1977 | Paxton | B27F 7/02 227/100 |
| 4,782,989 | A | 11/1988 | Wallin et al. | |
| 4,867,364 | A | 9/1989 | Wallin et al. | |
| 5,052,307 | A | 10/1991 | Morrison | |
| 5,312,022 | A | 5/1994 | Thompson et al. | |
| 5,335,499 | A | 8/1994 | Thompson et al. | |
| 5,379,513 | A | 1/1995 | Thompson et al. | |
| 5,715,985 | A | 2/1998 | Letson | |
| 5,984,621 | A | 11/1999 | Letson | |

OTHER PUBLICATIONS

Viking Engineering & Development, Viking Service, Skute Parts Book, Dec. 2013, 37 pages, Viking Engineering & Development, Fridley, MN.

* cited by examiner

*Primary Examiner* — John C Hong
(74) *Attorney, Agent, or Firm* — Erik Swenson

(57) ABSTRACT

In construction of pallets, stringers are conveyed on a conveyor in a conveying direction to a pneumatic stop assembly including a pawl. The pawl is moveably mounted relative to the conveyor by a parallelogram linkage and moveable by a pneumatic actuator between first and second heights relative to the conveyor. While the pawl is at its first height, a lower board in a hopper is pushed from a shelf by a pusher onto the stringers on the conveyor. While pushed, the ends of the board slide along and between first and second slide rails on opposite sides of the conveyor. The board on the stringers is sandwiched between the pusher and the pawl at the first height while fastened together by a nail gun. After being fastened together, the pawl is moved to its second height which does not interfere with the fastened board and stringers conveyed by the conveyor.

9 Claims, 7 Drawing Sheets

METHODS AND MACHINES FOR CONSTRUCTING PALLETS

CROSS REFERENCE

The present application claims benefit of U.S. Provisional Appln. No. 62/391,429 filed on Apr. 29, 2016, which is hereby incorporated herein by reference.

BACKGROUND

Methods and machines for constructing and, more particularly, methods and machines for constructing pallets are shown and described.

Pallets are used extensively to facilitate movement of all manner of goods and products in commerce. Such pallets are usually made of wood, and are available in many sizes and configurations depending upon the goods or products to be shipped. They generally consist of transverse boards fastened to opposite edges of longitudinal stringers. Although pallets are not of complicated construction, they are carefully designed to provide the required foundational support for the loads being carried. It is thus important that they be properly assembled to achieve the desired structural integrity.

In the past, pallets were constructed primarily by hand with powered nail guns. This technique was labor intensive, time consuming and inefficient. Production is limited.

More recently, machines have been available for automating pallet construction. Such machines are available from various sources, including Viking Engineering & Development of Fridley, Minn.

While pallet machines are much more efficient in producing pallets in greater volume, they have not been without their drawbacks. Inertial factors become more significant at high production rates. It thus becomes more difficult to maintain proper location and alignment of the components, which in turn can affect quality, structural integrity and durability of the pallets.

A need has thus arisen for new and improved methods and machines for constructing pallets that maintain proper alignment of the boards and stringers during high production rates.

SUMMARY

Improved pallet making machines and methods overcome the foregoing and other difficulties associated with the prior art. In one aspect, the pallet machine and methods herein incorporate pneumatic board stop assemblies and slide rails for accurate location of the boards and stringers prior to nailing. This in turn allows high production rates while maintaining repeatability, quality and structural integrity of the pallets.

Specifically, the first component illustrated as a stringer is moved in a conveying direction by a conveyor. A pawl is removably positioned at a first height relative to the first component and the conveyor. In the form illustrated, the pawl is moveably mounted by a parallelogram linkage to a base, with the first component moveable relative to the base on the conveyor. The pawl is moved such as by an actuator between the first height and a second height. A second component illustrated as a top board is supplied by a feeder on the first component and abutting with the pawl at the first height. In the form illustrated, a lower second component of a stack of second components contained in a hopper and supported on a shelf is pushed by a pusher from the shelf and beneath the stack onto the first component and sandwiches the second component against the pawl at the first height. Further, in the form illustrated, the second component slides between slide rails extending parallel to the conveyor. While abutting with the pawl at the first height, the second component is fastened to the first component such as by a nail gun as illustrated. After fastening, the pawl is moved to its second height and the fastened components are moved in the conveying direction past the pawl at the second height.

BRIEF DESCRIPTION OF THE DRAWINGS

A better understanding of the illustrative embodiments can be had by reference to the following Detailed Description in conjunction with the accompanying Drawings, wherein.

Figure 1:
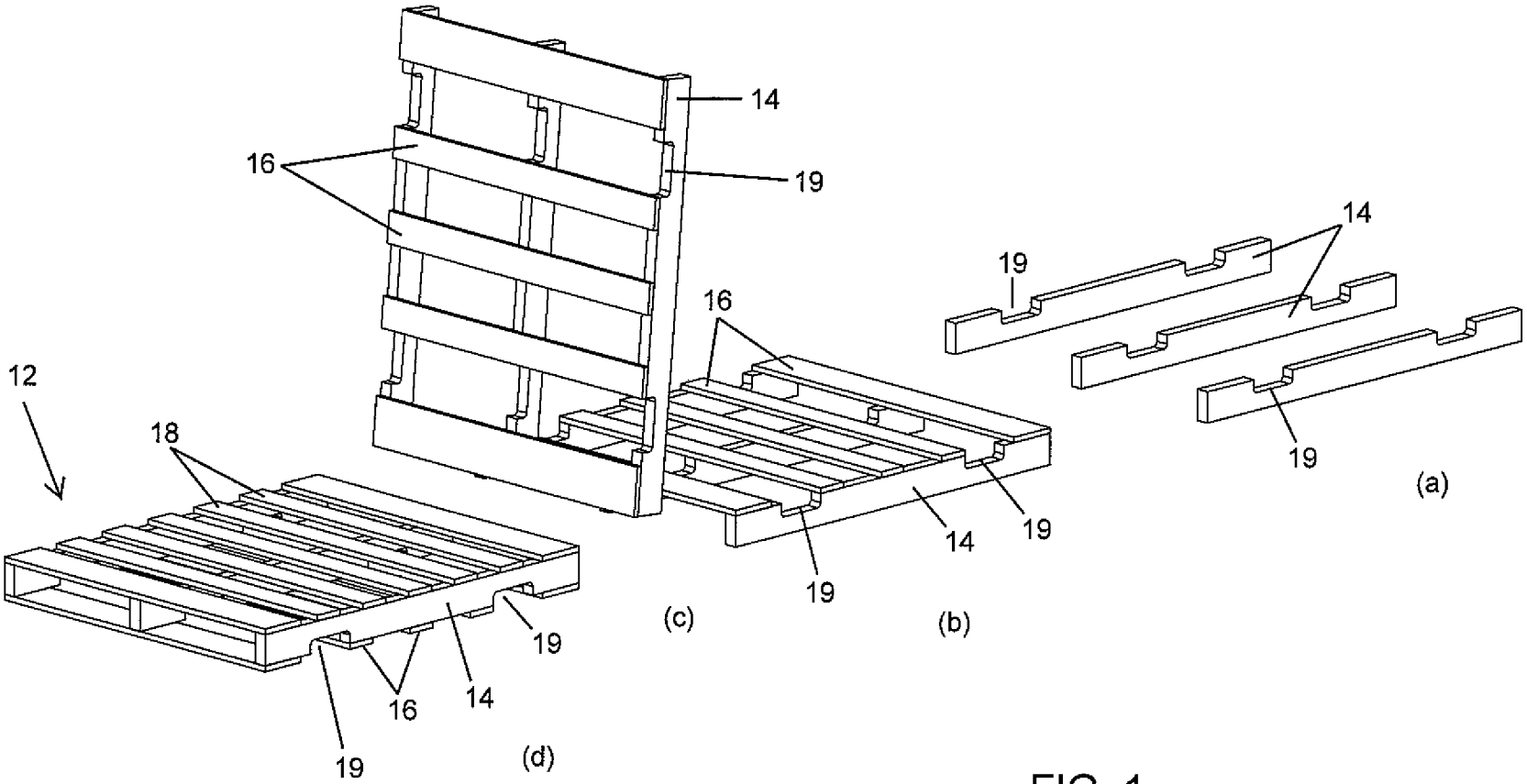
FIG. 1 Prior Art
FIG. 1 are perspective views showing the production of a pallet in a pallet machine.
Figure 2:
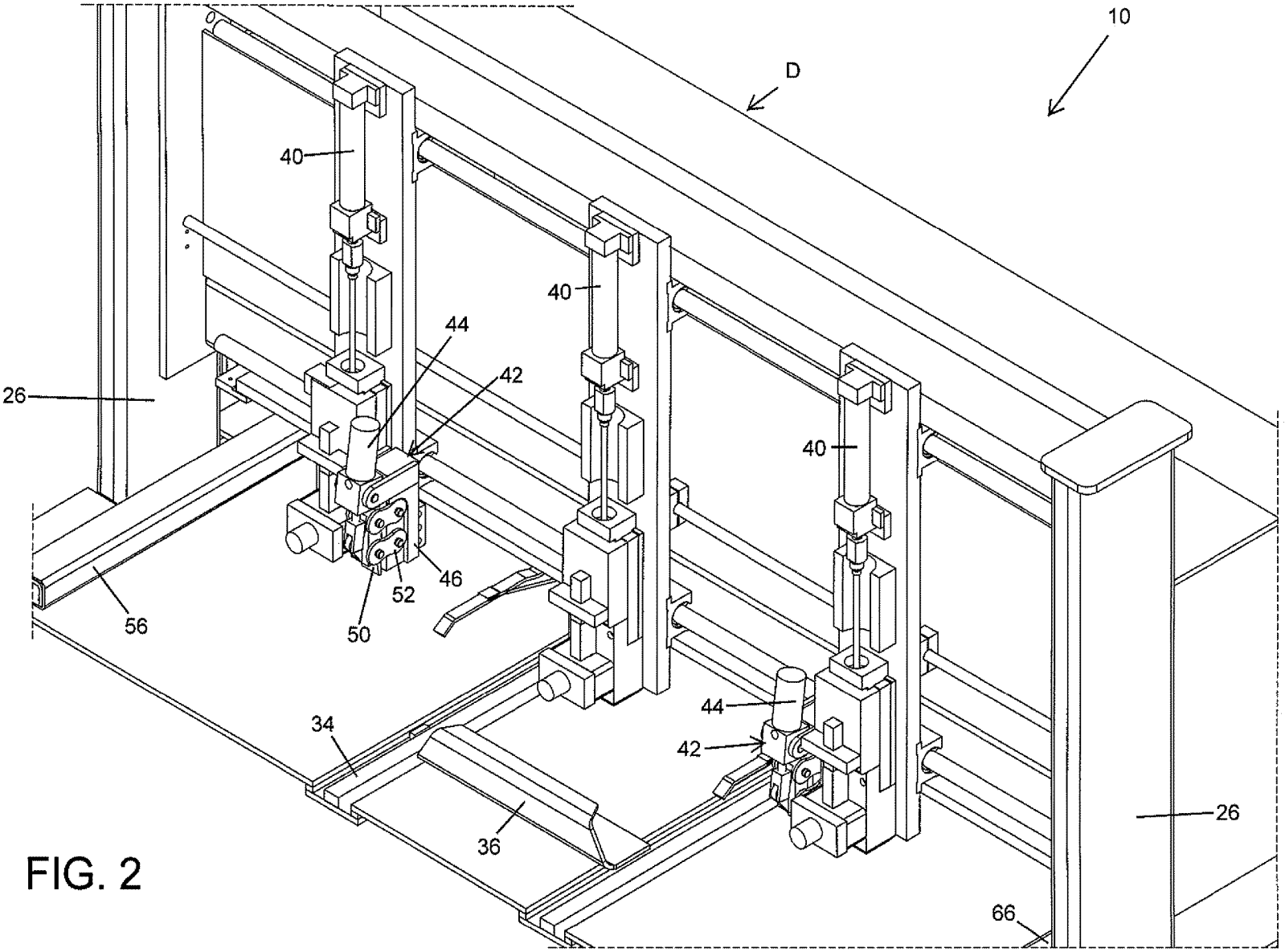
FIG. 2 is a perspective view of a pallet machine with portions broken away.
Figure 3:
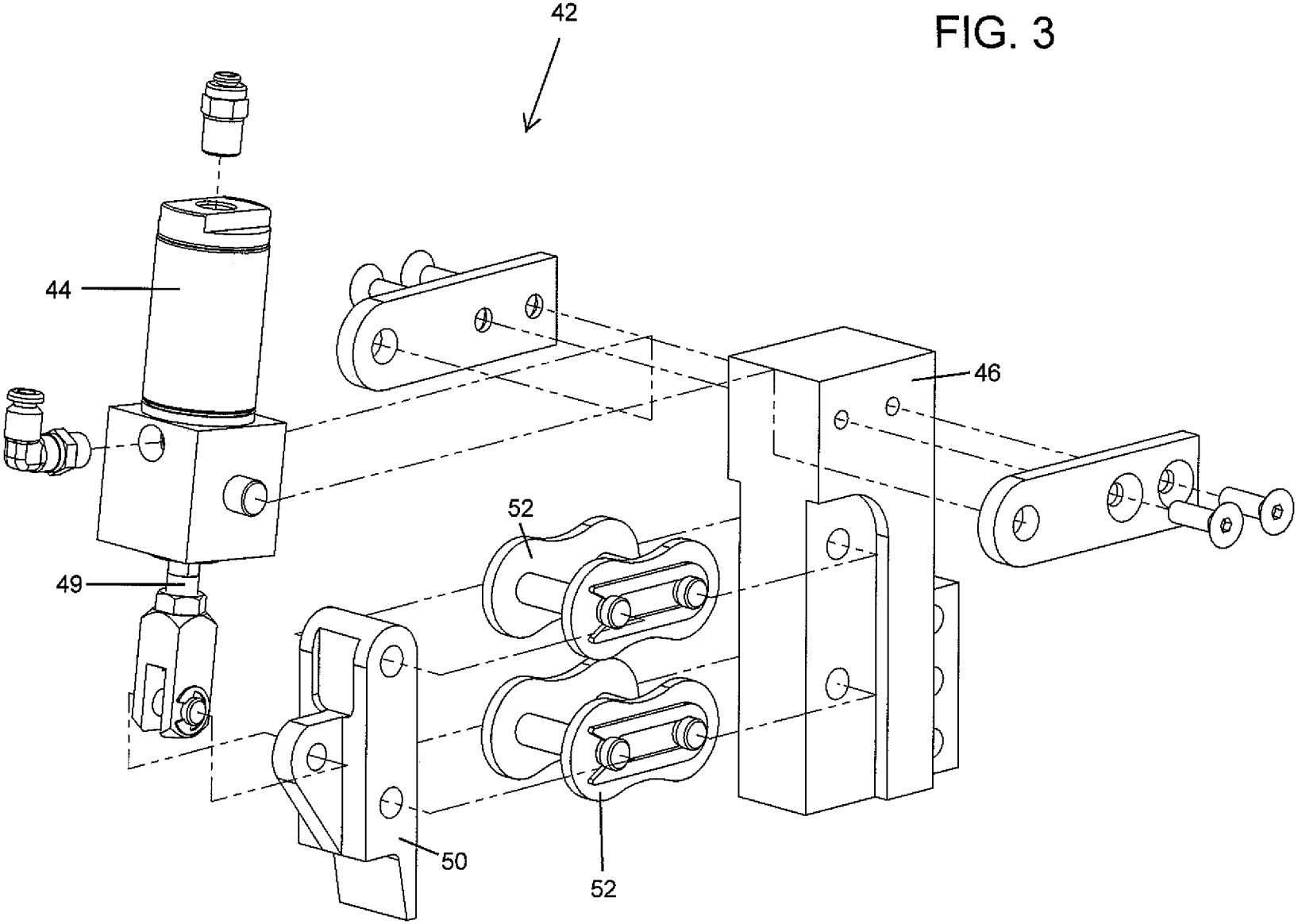
FIG. 3 is an exploded perspective view of a pneumatic stop assembly of the pallet machine of FIG. 2.
Figure 4:
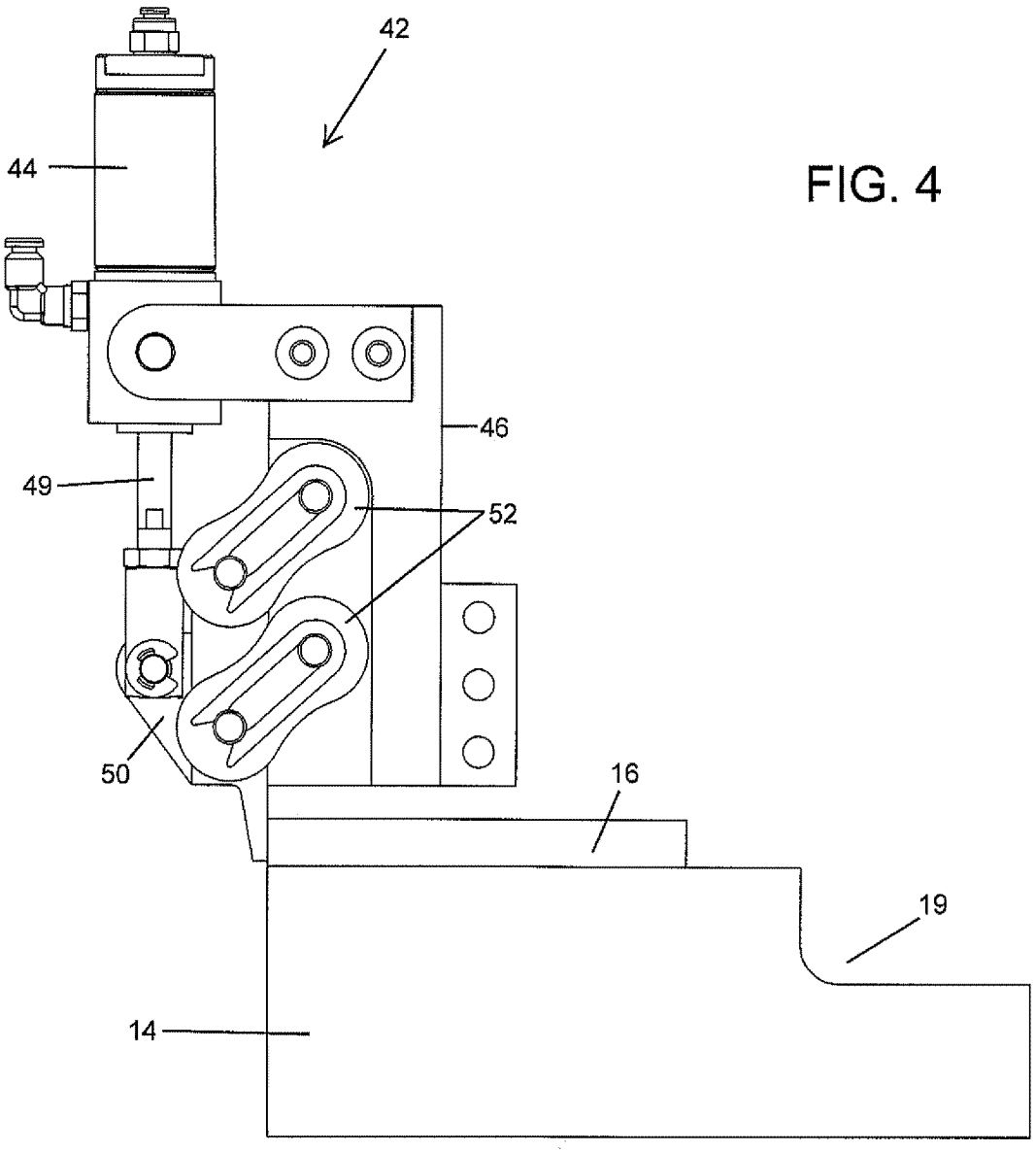
FIGS. 4 and 5 are elevational end views of the pneumatic stop assembly of FIG. 3.
Figure 5:
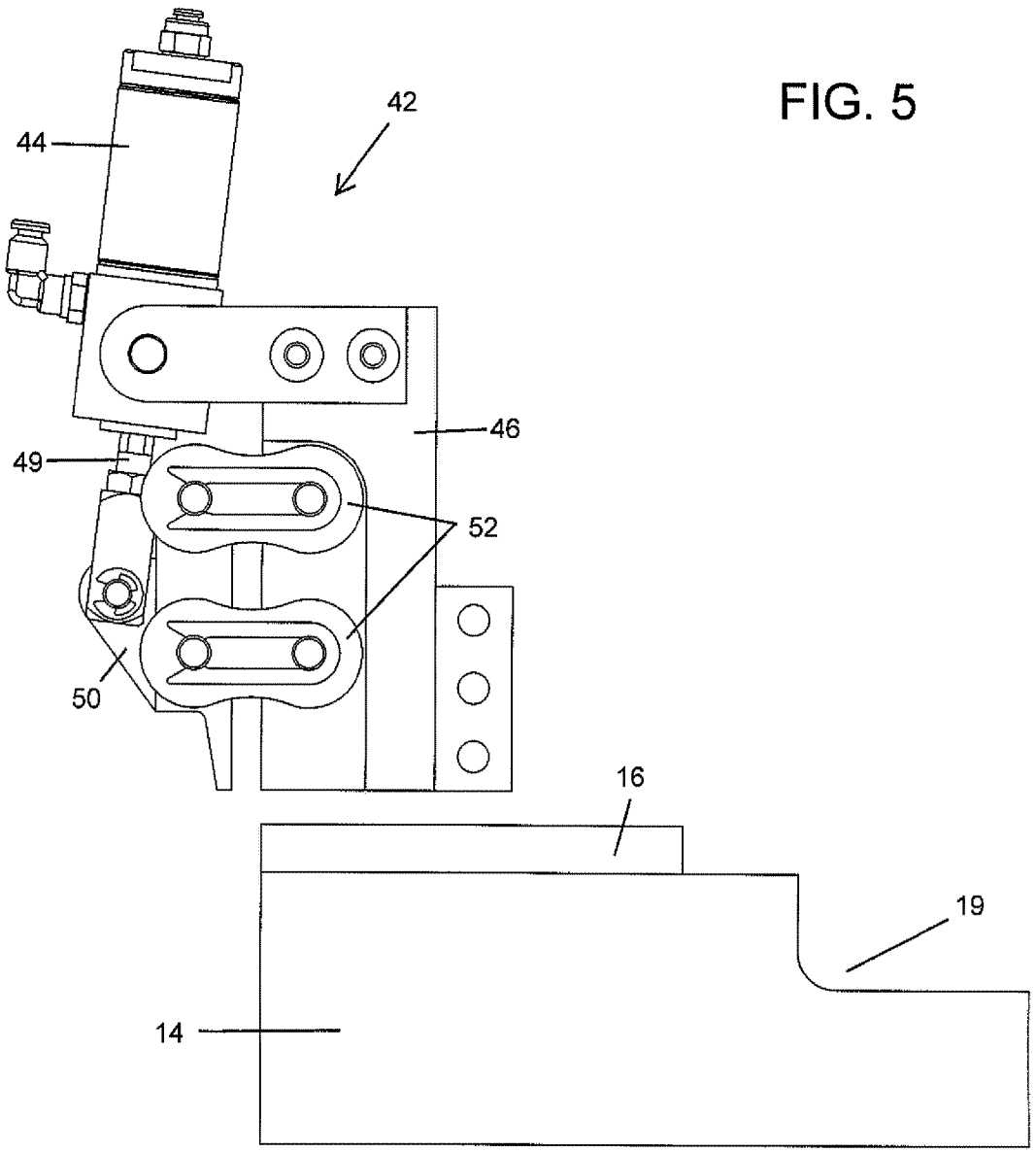
Figure 6:
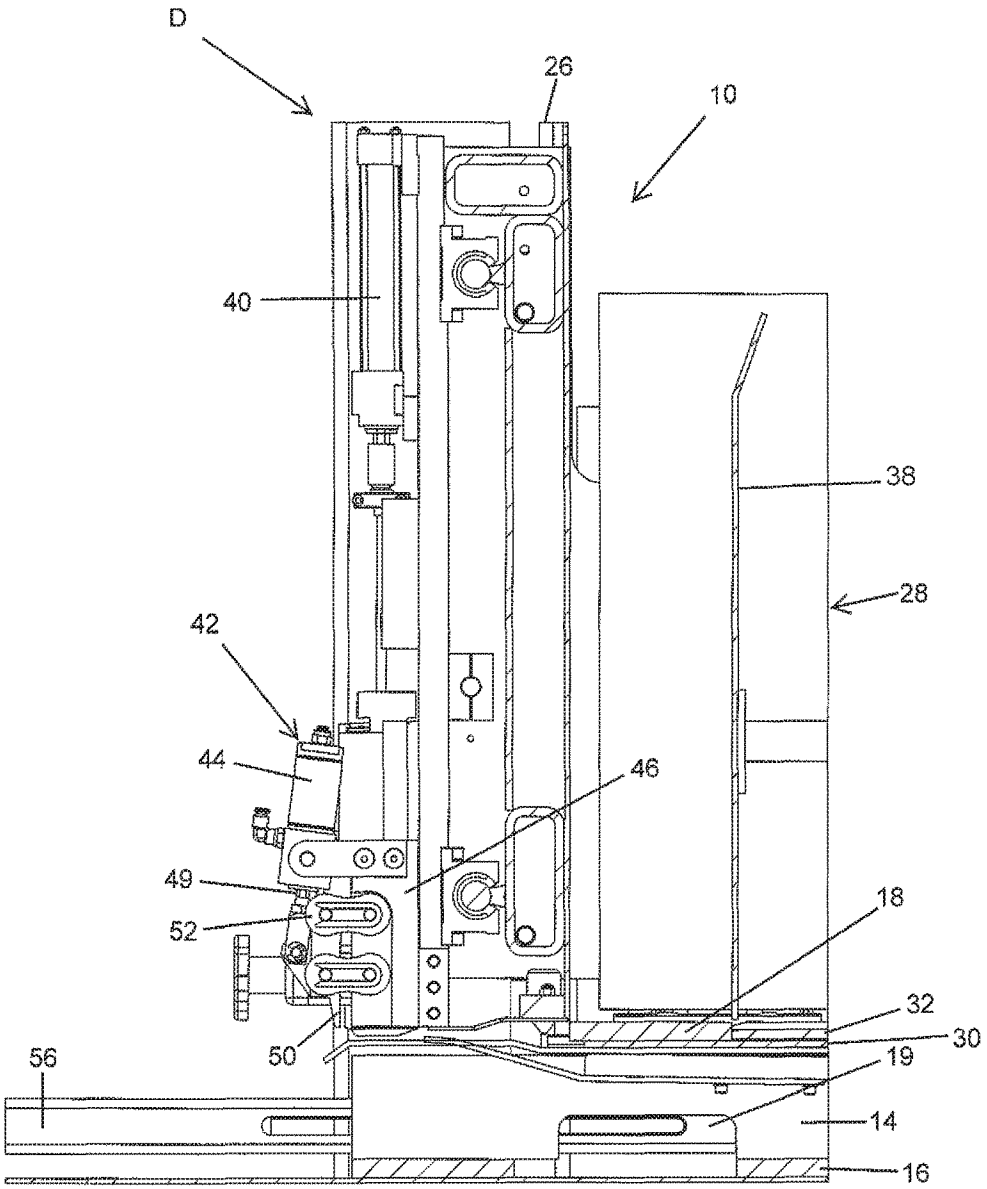
FIGS. 6 and 7 are elevational end views of the pallet machine of FIG. 2, with portions broken away.
Figure 7:
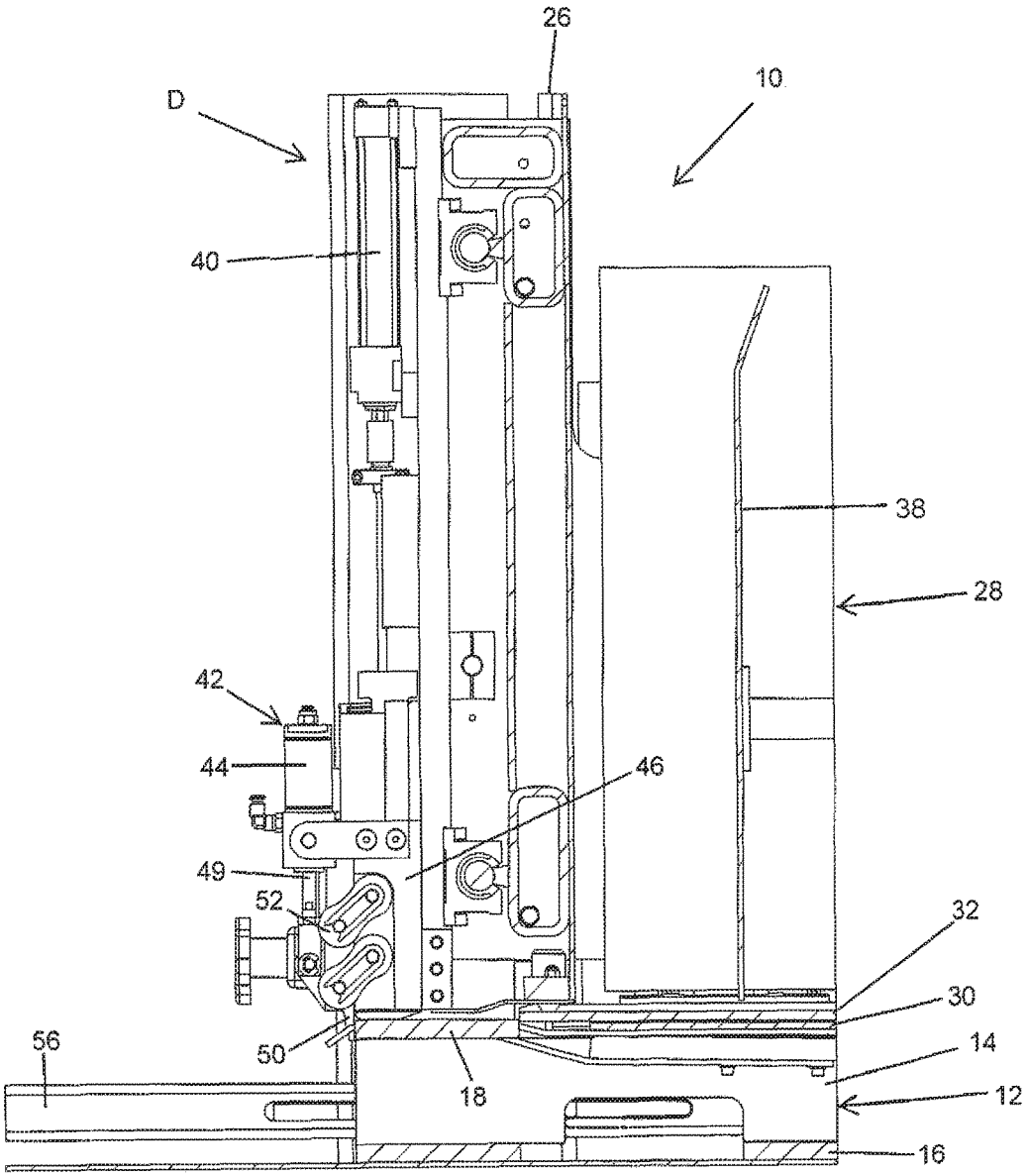

All figures are drawn for ease of explanation of the illustrative embodiments only; the extensions of the figures with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", "axial", "radial", "longitudinal", "lateral", and similar terms are used herein, it should be understood that these terms have reference only to the structure shown in the drawings as it would appear to a person viewing the drawings and are utilized only to facilitate describing the illustrative embodiments.

DETAILED DESCRIPTION

An improved pallet machine is shown in the drawings and generally designated 10. As will be explained more fully hereinafter, the pallet machine 10 allows for better control of the pallet components during manufacture to achieve high production rates while maintaining repeatability, quality and structural integrity of the pallets.

The pallet 12 consists of longitudinal stringers 14 and boards 16 and 18 fastened to the bottom and top edges, respectively, of the stringers 14. The stringers 14 include notches 19 in their bottom edges for receiving the ends of a forklift (not shown) for lifting the pallet 12.

The pallet machine 10 includes a first section where the stringers 14 are loaded into hoppers upside down with the notched, bottom edges of the stringers 14 facing upward. The stringers 14 are then advanced or indexed on a conveyor into a first nailing station, which includes a hopper loaded with bottom boards 16. The boards 16 are positioned on the stringers 14 and nailed in place by nail guns. The conveyor and nail guns may be constructed like those shown in U.S. Pat. Nos. 4,782,989, 5,312,022 and 5,379,5.13, the entire disclosures of which are incorporated herein by reference.

After the bottom boards 16 have been fastened to stringers 14, the semi-completed pallet 12 is advanced into a second section for marking or labeling of the stringers 14 as desired. The second section includes an intermediate conveyor for advancing the semi-completed pallet 12 along the feed path to a third section. An enclosure is also provided on either side of the conveyor of the second section.

After the semi-completed pallet 12 has been marked or labeled in the second section of the pallet machine 10, it is then turned upright by a turner or flipper in the third section so that the bottom boards 16 are down and the top edges of the stringers 14 are upright. The flipper may be constructed like that shown in U.S. Pat. No. 4,782,989.

After the semi-completed pallet 12 has been flipped upright in the third section, it is advanced into a fourth section D for fastening of the top boards 18. The fourth section D includes a frame 26, a conveyor 34 moveably mounted to the frame 26 for movement in a conveying direction, nail guns 40, and a hopper 38 loaded with top boards 18. The conveyor 34 is illustrated as an endless conveyor including spaced lugs 36 extending perpendicular to the conveying direction and abutting with the stringers 14. The top boards 18 are positioned on the stringers 14 and fastened thereto in the form illustrated by driving a fastener in the form of a nail in place by nail guns 40 to complete assembly of the pallet 12. The conveyor 34 and nail guns 40 of the fourth section D may be constructed like those shown in U.S. Pat. Nos. 4,782,989, 5,312,022 and 5,379,513.

In the illustrative embodiment, the fourth section D also includes pneumatic board stop assemblies 42 for engaging the leading edge of the each top board 18 so that it does not slide out of position before nailing. Each stop assembly 42 includes a pneumatic actuator having a cylinder 44 pivotally connected about an axis perpendicular to the conveying direction to a base or plate 46 in turn connected to the frame 26, to which the nail guns 40 are also secured. The end of a cylinder rod 49, which is extendable and retractable in the cylinder 44, is pivotally secured about an axis parallel to the axis of the cylinder 44 to a finger or pawl 50. The pawl 50, in turn, is also pivotally connected to the plate 46 by pairs of links 52 forming a parallelogram linkage between the pawl 50 and the plate 46. In the form illustrated, each link 52 is in the form of a roller chain link, which is believed to produce synergistic results in the manufacture and assembly of stop assemblies 42. Thus, the pawl 50 is moveably mounted to the plate 46 between first and second positions parallel to the plate 46 and perpendicular to the conveying direction. Particularly, the first position of pawl 50 is at a first height relative to the frame 26, and the second position of pawl 50 is at a second height relative to the frame 26 and greater than the first height. Pawl 50 can thus be actuated by cylinder 44 into engagement, first with the leading top board 18, and, then, with each of the other top boards 18, sequentially, so that each top board 18 is accurately aligned and longitudinally positioned for nailing.

First and second slide rails 56 and 66 extend parallel to the conveying direction and on opposite sides of the conveyor 34. The first and second slide rails 56 and 66 are spaced generally equal to and for slideably abutting the opposite ends of the top boards 18. Thus, first and second slide rails 56 and 66 accordingly align and laterally center the top boards 18 for nailing on stringers 14. It should be appreciated that one or both of first and second slide rails 56 and 66 can be adjustable for fitting top boards 18 of different lengths for pallets 12 of different sizes, with such adjustment being performed manually or with mechanical assistance such as pneumatically.

The fourth section D further includes a hopper 38 loaded with top boards 18 stacked on each other. A feeder 28 supplies the top board 18 onto the stringers 14 and abutting the top board 18 with the pawl 50 in the first position by removing one of the top boards 18 from the hopper 26, placing it on the stringers 14 conveyed by the conveyor 34 and sandwiching the removed top board 18 against the pawls 50 of the stop assemblies 42. In the illustrative embodiment, a shelf 30 extends generally parallel to the conveying direction and below and spaced from the lower end of the hopper 26, a distance slightly greater than the height of one top board 18. A pusher 32 in the form of a plate is moveable relative to the hopper 38 and the shelf 30 in the conveying direction between a load position outside the lower end of the hopper and a feed position extending below the hopper 38 and beyond the shelf 30. Thus, by moving from the load position to the feed position, the lower top board 18 in the hopper 38 is slid on the shelf 30 onto the stringers 14 and is sandwiched against the pawls 50 in their first position, with the feeder 28 supplying the top board 18 intermediate the slide rails 56 and 66. After nailing, pusher 32 is moved from the feed position to the load position, allowing the then lower top board 18 to be supported on the shelf 30. Further, the pawl 50 is moved to its second position to be spaced from the pallet 12 which can then be moved by the conveyor 34 in the conveying direction.

After assembly of pallet 12 has been completed in the fourth section D, it is then advanced to a fifth section for stacking and removal. The fifth section may be constructed like that shown in U.S. Pat. No. 5,984,621, the entire disclosure of which is incorporated by reference herein.

From the foregoing, it will be appreciated that an improved pallet machine and methods have several advantages over the prior art. One significant advantage is that the pallet machine herein provides for more accurate longitudinal and lateral alignment of the boards on the stringers during nailing. High production rates can be achieved while maintaining repeatability, quality and structural integrity of the pallets. Other advantages will be evident to those skilled in the art.

Although pneumatic board stop assemblies 42 are shown and described in the fourth section D, it should be appreciated that pneumatic board stop assemblies 42 are also included in the first nailing station for accurate longitudinal and lateral alignment of the bottom boards 16 on the stringers 14.

Furthermore, although shown and described in regard to constructing pallets 12, which is believed to produce synergistic results, the machine 10 and methods described herein can have application to fastening first and second components to construct structures other than pallets 12.

Although particular embodiments of the invention have been illustrated in the accompanying drawings and described in the foregoing detailed description, it will be understood that the invention is not limited only to the embodiments disclosed, but is intended to embrace any equivalents, modifications and/or rearrangements of elements falling within the scope of the invention disclosed herein.

The invention claimed is:

1. Machine for constructing a structure including a first component and a second component, comprising, in combination: a frame; a conveyor moveably mounted to the frame for movement in a conveying direction and adapted to move the first component in the conveying direction; a base connected to the frame; a pawl moveably mounted to the base via a parallelogram linkage, the pawl moveable between a first position at a first height relative to the frame and a second position at a second height relative to the frame and greater than the first height, with the pawl moveable between the first and second positions parallel to the base and perpendicular to the conveying direction; a gun driving a fastener into the first and second components; and a feeder supplying the second component onto the first component and abutting the second component with the pawl in the first position.

2. The machine of claim 1, wherein the parallelogram linkage comprises first and second roller chain links extending through the base and the pawl.

3. The machine of claim 2, further comprising, in combination: a cylinder pivotally mounted to the base about an axis perpendicular to the conveying direction and a cylinder rod extendable and retractable in the cylinder and having an end pivotably mounted to the pawl about an axis parallel to the axis of the cylinder.

4. The machine of claim 3, further comprising, in combination: first and second slide rails extending parallel to the conveying direction and on opposite sides of the conveyor, with the feeder adapted to supply the second component intermediate the first and second slide rails.

5. The machine of claim 4, further comprising, in combination: a hopper adapted to contain multiple second components stacked on each other; wherein the feeder comprises a pusher moveable in the conveying direction between a load position outside a lower end of the hopper and a feed position extending below and beyond the hopper, with the pusher adapted to push a lower second component from the hopper to be sandwiched between the pawl in the first position and the pusher in the feed position.

6. The machine of claim 5, wherein the conveyor comprises an endless conveyor moving in the conveying direction, with the endless conveyer including spaced lugs extending perpendicular to the conveying direction and abutting with the first component.

7. The machine of claim 6, wherein the gun comprises a nail gun.

8. The machine of claim 1, further comprising, in combination: a cylinder pivotally mounted to the base about an axis perpendicular to the conveying direction and a cylinder rod extendable and retractable in the cylinder and having an end pivotably mounted to the pawl about an axis parallel to the axis of the cylinder.

9. The machine of claim 1, further comprising, in combination: a hopper adapted to contain multiple second components stacked on each other; wherein the feeder comprises a pusher moveable in the conveying direction between a load position outside a lower end of the hopper and a feed position extending below the hopper, with the pusher adapted to push a lower second component from the hopper to be sandwiched between the pawl in the first position and the pusher in the feed position.

* * * * *